United States Patent [19]

Bianchi et al.

[11] Patent Number: 4,781,007

[45] Date of Patent: Nov. 1, 1988

[54] DEPLOYABLE WOODEN OSSATURE

[76] Inventors: Jean-Luc F. Bianchi, 40, rue des Canus, 78600 Maisons Laffitte; Roland Y. Legrand, 4, Boulevard du Temple, 75011 Paris, both of France

[21] Appl. No.: 124,411

[22] Filed: Nov. 20, 1987

Related U.S. Application Data

[63] Continuation of Ser. No. 795,849, Nov. 7, 1985, abandoned.

[51] Int. Cl.[4] ..... E04B 1/26

[52] U.S. Cl. ..... 52/646; 52/109; 160/130

[58] Field of Search ..... 52/109, 646, 227, 648; 160/159, 130; 256/1, 73

[56] References Cited

U.S. PATENT DOCUMENTS

| | | | |
|---|---|---|---|
| 74,908 | 2/1868 | Gaskill | 256/73 |
| 861,217 | 7/1907 | Fritz | 52/650 |
| 1,251,213 | 12/1907 | Fritz | 160/159 |
| 1,702,340 | 2/1929 | Gates | 52/227 |
| 2,036,363 | 4/1936 | Schaefer | 52/646 |
| 2,256,394 | 9/1941 | Lamel | 52/227 |

FOREIGN PATENT DOCUMENTS

| | | | |
|---|---|---|---|
| 0063662 | 3/1982 | European Pat. Off. | 52/645 |
| 868508 | 2/1953 | Fed. Rep. of Germany | 52/645 |
| 923126 | 2/1947 | France . | |
| 334027 | 1/1936 | Italy | 52/109 |
| 573446 | 11/1945 | United Kingdom | 52/426 |

*Primary Examiner*—James L. Ridgill, Jr.
*Attorney, Agent, or Firm*—Armstrong, Nikaido, Marmelstein & Kubovcik

[57] ABSTRACT

An ossature comprising a truss constituted by a plurality of mutually parallel vertical elements, and a lower rail and an upper rail on which the ends of the vertical elements engage when the truss is deployed, is characterized by the fact that these vertical elements are connected together by at least one strap which is perpendicular to them when the truss is deployed.

9 Claims, 2 Drawing Sheets

DEPLOYABLE WOODEN OSSATURE

This is a continuation of application Ser. No. 795,849, filed Nov. 7, 1985, and (now abandoned).

FIELD OF THE INVENTION

The present invention relates to a deployable wooden ossature which is in particular useful alone or in a collective construction.

PRIOR ART

Such ossatures of wood are already known, as for example that described in FR-A-2,468,699. The latter in particular relates to a pre-fabricated truss which is foldable into a storage and transport position but capable of being unfolded at the erection site for obtaining an ossature. This truss is constituted from a plurality of mutually parallel longitudinal elements which are connected by transverse members articulated to them permitting the passage of the assembly of the elements into a folded position in which the longitudinal elements as well as the folded transverse elements are disposed parallel and in contact with one another and into a displaced position in which the longitudinal elements, remaining parallel, are held in spaced position and at a suitable distance by the transverse members guided into a perpendicular position relative to the longitudinal elements.

Such a truss only permits constructions comprising a single level; furthermore height when folded with the longitudinal elements vertical is greater than when it is unfolded and this represents a disadvantage for storing and transport.

OBJECTS OF THE INVENTION

It is an object of the present invention is to provide a wood ossature which is equally able to provide constructions at a single level as constructions at several levels.

Another object of the invention is to provide such an ossature whose height is the same when it is folded or unfolded.

A further object of the present invention is to provide an ossature of this type whose manufacture does not involve a considerable investment and may be easily computerised.

Another object of the invention is that the transport of the constituent elements of this ossature does not involve lifting tackle.

SUMMARY OF THE INVENTION

These objects, as well as others which will appear from the following, are achieved by a wooden ossature comprising a truss constituted by a plurality of mutually parallel vertical elements, a lower rail, and an upper rail on which the ends of the vertical elements bear when the truss is deployed. According to the present invention the vertical elements are connected together by at least one strap which is perpendicular to them when the truss is deployed.

Advantageously, the vertical elements are each constituted by two strips which are assembled by at least two metal junction brackets through which the strap passes.

Preferably, the rails comprise regularly spaced holes for fixing the vertical elements.

As for the straps, they are constituted by thin cross-section metal wires connecting the vertical elements in pairs.

In a particular embodiment of the invention, the ossature comprises a lintel disposed at the upper ends of the vertical elements and under the upper rail.

BRIEF DESCRIPTION OF THE DRAWINGS

The description which follows and which is not in any way to limit the invention will enable the man in the art to be able to understand the present invention better, and thus to be able to reproduce it. It should be read in conjunction with the accompanying drawings, in which.

DESCRIPTION OF THE PREFERRED EMBODIMENT

Figure 1:
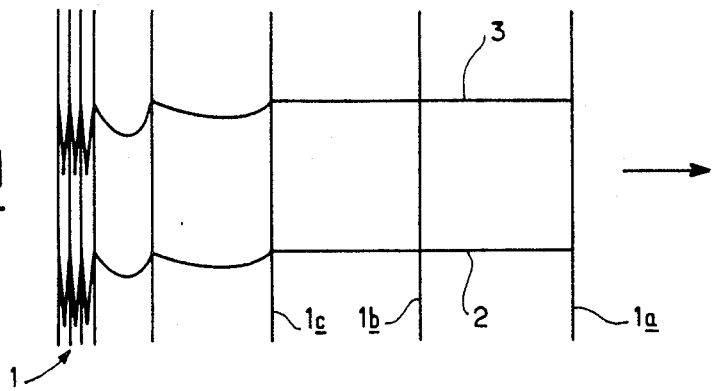
FIG. 1 is a schematic view of an ossature according to the invention, in the process of installation.
Figure 2:
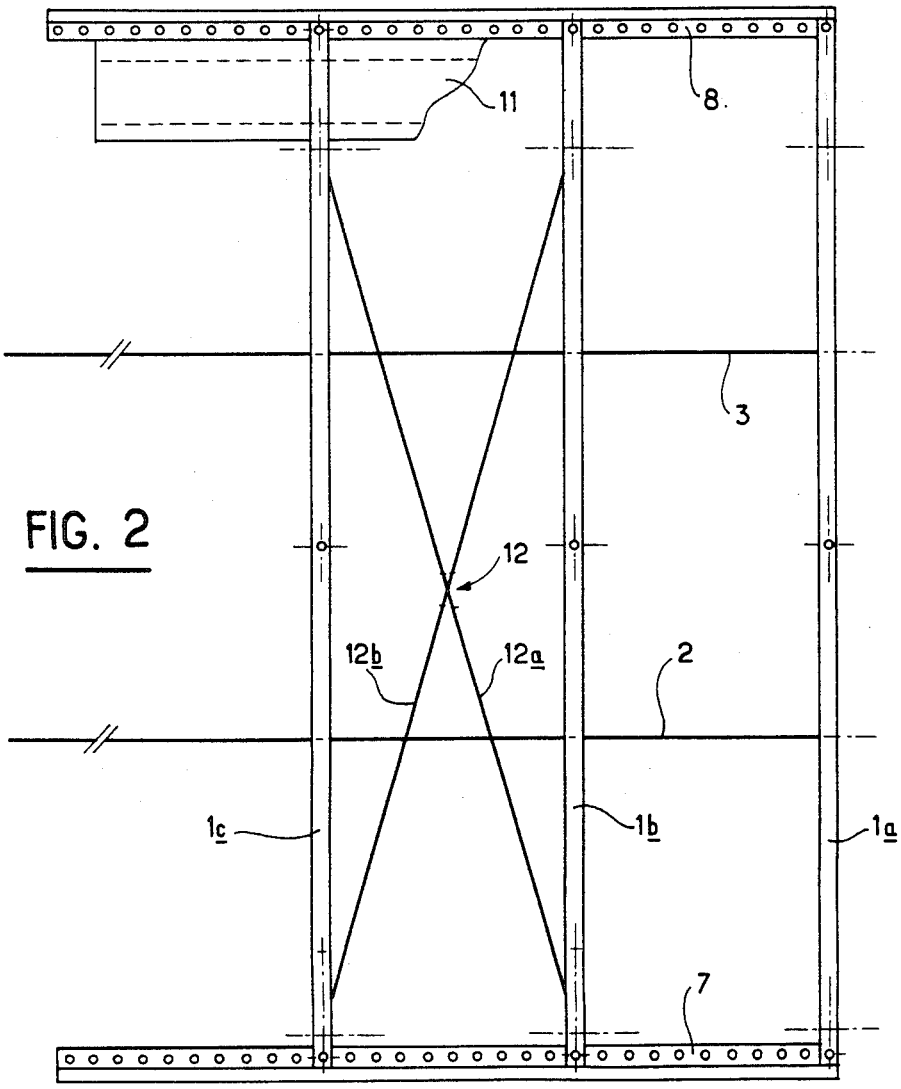
FIG. 2 shows a detail view of the erected ossature.
Figure 4:
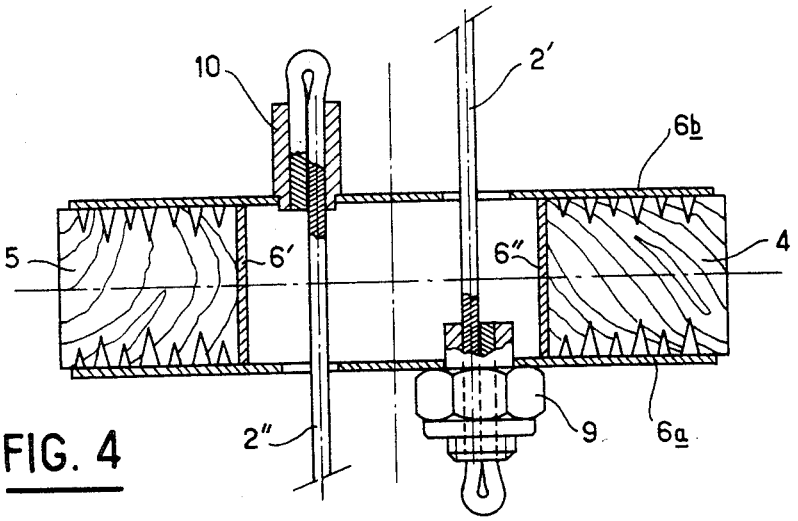
FIG. 4 is a sectional view of this junction bracket on the line IV—IV of FIG. 3.
Figure 3:
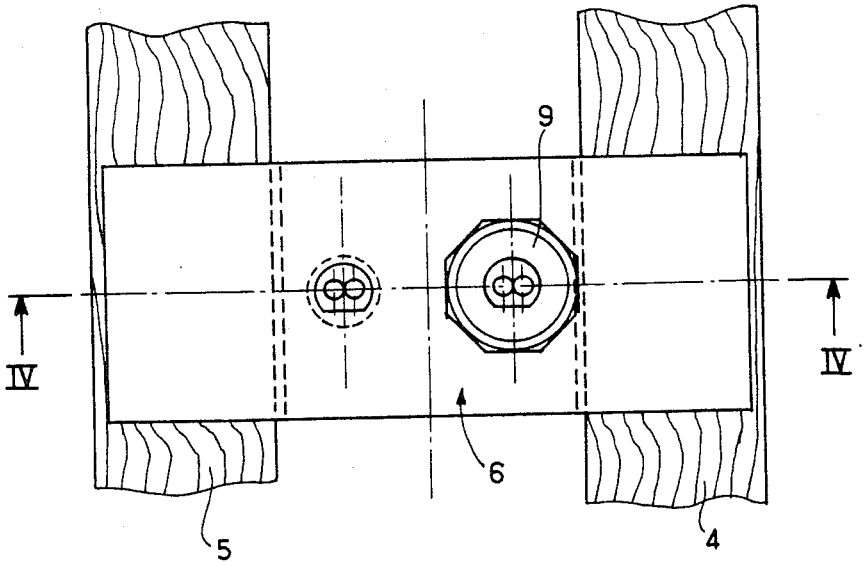
FIG. 3 shows an end view of a junction bracket.

As may be seen from FIG. 1, a wooden ossature according to the present invention comprises a truss, designated in its entirety by the reference 1, which is constituted by a plurality of vertical elements 1*a* 1*b*, 1*c*, parallel to one another. These vertical elements are connected together by two straps 2 and 3 in the present embodiment, which are perpendicular to vertical elements when the truss is erected as shown in FIG. 2.

Each vertical element 1*a*, 1*b* is constituted by two wooden strips 4 and 5 which are assembled by means of two junction brackets 6. Each bracket 6 comprises two parallel plates 6*a* and 6*b* connected by two transverse members 6' and 6'' which are perpendicular to them. These strips 4 and 5 are situated in the parts of the U thus defined by the two plates 6*a* and 6*b* and the two transverse members 6' and 6'': the central space provided between the two strips permits mortising of the rails as described below.

The ossature also comprises two rails: a lower rail 7 and an upper rail 8, which are disposed respectively at the lower and upper ends of the vertical elements. These rails advantageously comprise regularly spaced holes permitting fixing of the vertical elements, in particular by pinning.

As for the straps 2 and 3, these are metal wires of narrow cross-section ensuring not only the connect-ion of two adjacent ones of the vertical elements, but also their mutual spacing. These straps are in engagement by their two ends on a function bracket 6: the one by a fixed nipple and the other by an adjustable nipple enabling its tension to be determined in such a way that the straps oppose buckling of the vertical elements. These straps also help to maintain the junction brackets on the corresponding strips.

Thus on a single junction bracket and in the same horizontal plane are fixed two straps 2' and 2'': one by an adjustable nipple 9 and the other by a fixed nipple 10, in a manner known per se. Each continuous strap 2 or 3 is thus in fact constituted by successive individual straps connecting the vertical elements in pairs.

In particular when it is necessary to construct bearer walls, this ossature may also comprise a lintel 11 which is disposed at the upper end of the vertical elements and below the upper rail 8. This lintel 11 is held in position relative to the vertical elements, by means of nails;

further it can also rest on the junction brackets 6. It makes it possible to resist the loading of roofing elements or floor elements: due to this fact it is not obligatory for the vertical elements to be in register with the roofing elements, or the vertical elements of the next storey above, or the joisting of the floor of the next storey.

The use of a wooden ossature according to the present invention is relatively simple. The lower rail 7 is placed in a known manner on a plane, generally of masonry. Then the wooden truss 1 is deployed on the rail and each vertical element 1*a*, 1*b*, 1*c* is fixed on this lower rail 7 by mortising and pinning.

In the case of non-load bearing walls, the upper rail 8 is placed in position and will be assembled by mortising and pinning on the upper end of each vertical element. On the contrary, in the case of load bearing walls a lintel 11 is disposed on the preceding structure and is assembled by mortising with each vertical element and to which it can be fixed by any suitable means.

Subsequently the walls are made stable against wind by means of bracing 12 which constitutes two ties 12*a* and 12*b* forming substantially a St. Andrew's Cross between the successive vertical elements. The positioning and the number of the ties will be determined for each type of embodiment. The ties 12*a* and 12*b* may in particular be constituted by metal cables or by rigid metal members.

The squaring of the truss 1 may be achieved by means of two wooden panels disposed to either side of it, fixed by pinning to the lower and upper rails, and encasing between them two consecutive vertical elements. Due to this fact, the panels also help to stabilize the structure against wind.

We claim:

1. A deployable wooden ossature comprising, truss means comprising a plurality of spaced apart mutually parallel vertical wooden elements having upper and lower ends;

said vertical elements being connected together by at least one strap which is sufficiently flexible to enable the vertical elements to be positioned in side by side adjacent relation to each other for storage and transportation;

said at least one strap being perpendicular to said plurality of vertical elements when the truss means is deployed;

lower rail means engaging the lower ends of said vertical elements when the truss means is deployed; and upper rail means engaging the upper ends of said vertical elements when the truss means is deployed;

said at least one strap comprising means adapted to be tensioned between said vertical elements when said truss means is deployed, to strengthen the resulting structure. .

2. A wooden ossature according to claim 1 wherein, said at least one flexible strap comprises a plurality of straps, each strap connecting a different pair of two of said vertical elements together.

3. An ossature according to claim 1, wherein each said vertical element is constituted by two wooden strips which are assembled by at least two metal junction brackets through which the said at least one strap passes.

4. An ossature according to claim 1, wherein said lower rail means and said upper rail means comprise means defining regularly spaced holes for fixing of said vertical elements thereto.

5. An ossature according to claim 1, wherein said at least one strap connects said vertical elements in pairs.

6. An ossature according to claim 1, wherein said at least one strap is a thin metal cable.

7. An ossature according to claim 1, further comprising a lintel disposed at the upper ends of said vertical elements but below the upper rail means.

8. An ossature according to claim 1, and further comprising brace means disposed between every two adjacent vertical elements.

9. An ossature according to claim 8, wherein said brace means comprise two ties forming substantially a St. Andrew's cross.

* * * * *